US009970221B2

(12) United States Patent
Rudraraju et al.

(10) Patent No.: US 9,970,221 B2
(45) Date of Patent: May 15, 2018

(54) DOOR HANDLE ASSEMBLY FOR MOTOR VEHICLE

(71) Applicants: Hyundai Motor Company, Seoul (KR); Kia Motors Corporation, Seoul (KR); HYUNDAI MOTOR INDIA ENGINEERING PVT, LTD., Hyderbad (IN)

(72) Inventors: Ch P K N Varma Rudraraju, Hyderbad (KR); Youn Seob Kim, Hwaseong-si (KR)

(73) Assignees: Hyundai Motor Company, Seoul (KR); Kia Motors Corporation, Seoul (KR); HYUNDAI MOTOR INDIA ENGINEERING PVT, LTD., Hyderbad (IN)

( * ) Notice: Subject to any disclaimer, the term of this patent is extended or adjusted under 35 U.S.C. 154(b) by 176 days.

(21) Appl. No.: 14/676,457

(22) Filed: Apr. 1, 2015

(65) Prior Publication Data

US 2016/0076280 A1 Mar. 17, 2016

(30) Foreign Application Priority Data

Sep. 12, 2014 (IN) ..... 2636/DEL/2014

(51) Int. Cl.
*E05B 3/00* (2006.01)
*E05B 85/16* (2014.01)
*E05B 77/06* (2014.01)

(52) U.S. Cl.
CPC ..... *E05B 85/16* (2013.01); *E05B 77/06* (2013.01)

(58) Field of Classification Search
CPC ..... E05B 85/16; E05B 77/06; E05B 77/04
(Continued)

(56) References Cited

U.S. PATENT DOCUMENTS 8,366,159 B2 * 2/2013 Patel ..... E05B 77/06 292/203
8,833,812 B2 * 9/2014 Sakai ..... E05B 77/04 292/336.3

(Continued)

FOREIGN PATENT DOCUMENTS

JP 2012-154073 A 8/2012
KR 10-0737001 81 7/2007

(Continued)

*Primary Examiner* — Kristina Fulton
*Assistant Examiner* — Faria Ahmad
(74) *Attorney, Agent, or Firm* — Morgan, Lewis & Bockius LLP

(57) ABSTRACT

A door handle assembly configured for installation in a motor vehicle door may include a housing accommodating an actuator mechanism, a grip assembly activating the actuator mechanism, wherein the actuator mechanism includes a plurality of levers juxtaposed to each other and pivotably positioned in the housing, and the plurality of levers having a first lever and a second lever, wherein the first lever and the second lever may be positioned to be in contact with a grip lever during a normal working condition and during a side impact condition of the vehicle, thereby exerting a holding force on the grip lever, and wherein after experiencing the side impact, the first lever may be configured to rotate about a pivot and the second lever continues exerting the holding force on the grip lever.

7 Claims, 15 Drawing Sheets

(58) Field of Classification Search
USPC ..... 292/336.3, DIG. 22, DIG. 30
See application file for complete search history.

(56) References Cited

U.S. PATENT DOCUMENTS

| | | | | |
|---|---|---|---|---|
| 2007/0080547 | A1* | 4/2007 | Lee | E05B 77/06 292/336.3 |
| 2009/0085360 | A1* | 4/2009 | Bertolotti | E05B 77/06 292/336.3 |
| 2009/0102206 | A1* | 4/2009 | Lee | E05B 77/06 292/336.3 |
| 2011/0163554 | A1* | 7/2011 | Patel | E05B 77/06 292/216 |
| 2015/0042111 | A1* | 2/2015 | Ichikawa | E05B 77/06 292/336.3 |
| 2015/0167347 | A1* | 6/2015 | Park | E05B 85/16 16/412 |
| 2016/0060913 | A1* | 3/2016 | Kim | E05B 79/22 292/336.3 |
| 2016/0130845 | A1* | 5/2016 | Park | E05B 77/06 292/336.3 |

FOREIGN PATENT DOCUMENTS

| | | | |
|---|---|---|---|
| KR | 10-0897693 | B1 | 5/2009 |
| KR | 10-2009-0062866 | A | 6/2009 |

* cited by examiner

DOOR HANDLE ASSEMBLY FOR MOTOR VEHICLE

CROSS-REFERENCE TO RELATED APPLICATION

The present application claims under 35 U.S.C. § 119(a) the benefit of Indian Patent Application No. 2636/DEL/2014 filed on Sep. 12, 2014, the entire contents of which is incorporated herein for all purposes by this reference.

BACKGROUND OF THE INVENTION

Field of the Invention

The present subject matter described herein generally relates to a mechanism employed in the door assembly of a motor vehicle and, more particularly, to a mechanism that avoids the release or opening of the motor vehicle door during a side impact.

Description of Related Art

There have been several ways employed in the past to prevent a vehicle door from releasing or opening during critical or adverse circumstances such as, side impact. One such mechanism configured in the vehicle door assembly 10 of the prior art is illustrated in FIGS. 1A, 1B, 2, 3A, 3B, 4A and 4B. On experiencing the initial force, consequent to the side impact i.e. during the side impact, a handle grip 12 located on an outer surface 14 of the vehicle door moves in a direction opposite to the direction of the force exerted by the side impact. A balance load 16 is added to an outside handle lever 18 that generates a holding force on a grip lever 20. This prevents the handle grip 12 from opening during the state of impact and thus, the consequent releasing or opening of the door.

However, after experiencing the force exerted by the side impact, the handle grip 12 moves in the direction of the force exerted by the side impact. On account of the force of inertia resisting the initial force of impact, the balance load 16 pushes the outside handle lever 18 on which it is placed. This displacement of the outside handle lever 18 releases an outer surface handle rod 22 from its set position and thus, results in releasing or opening of the door and associated safety hazards.

In view of above, it is of vital importance to obviate the shortcomings prevalent in conventional alternatives or solutions provided in state of the art, leading to life-threatening safety concerns. At the same time, it is a subject of utmost importance to keep in mind the economical and feasibility aspects of any new solution or alternative to the above described drawback. In view of foregoing, it is the need of the hour to provide a simple and reliable mechanism in terms of cost involved and minimum design around of the surrounding or existing components that overcomes the above and other drawbacks.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to avoiding release of outside handle lever during side impact, providing different set of levers for a balance load and an outside handle rod, increasing safety by avoiding the opening of a vehicle door during and after a side impact, achieving a safety oriented mechanism with reasonable costs, and introducing a safe and an efficient door mechanism in place with least design changes in existing components.

In an aspect of the present invention, a door handle assembly configured for installation in a motor vehicle door, may include a housing accommodating an actuator mechanism, and a grip assembly activating the actuator mechanism, wherein the actuator mechanism may include a plurality of levers juxtaposed to each other and pivotably positioned in the housing, the plurality of levers having a first lever and a second lever, wherein the first lever and the second lever are positioned to be in contact with a grip lever during a normal working condition and during a side impact condition of the vehicle, thereby exerting a holding force on the grip lever, and wherein after experiencing the side impact, the first lever is configured to rotate about a pivot and the second lever continues exerting the holding force on the grip lever.

The grip assembly is attached to an outer surface of the housing.

The first lever is spring loaded.

The first lever and the second lever are pivoted within the housing by a pivot shaft.

The first lever is configured to carry a balance load and the second lever is configured to carry an outside handle rod.

The first lever and the second lever are in contact with a grip lever at a bottom end thereof.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
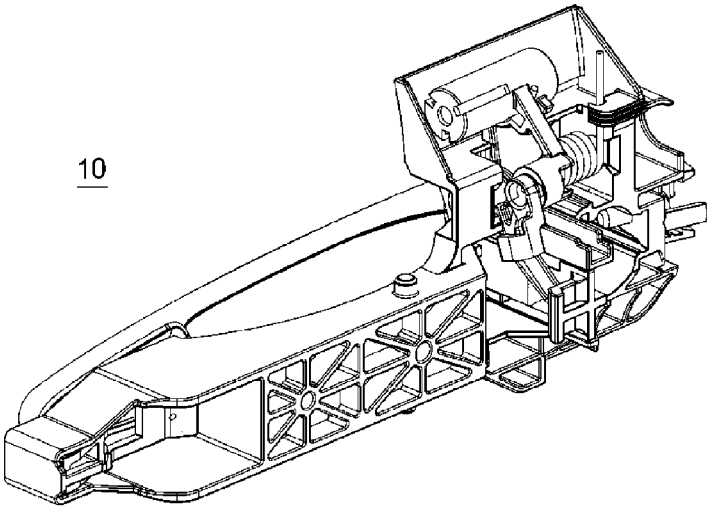
FIG.1A (Related Art)
FIG. 1A represents a front view of a door assembly of a vehicle in accordance with state of the art.
Figure 1B:
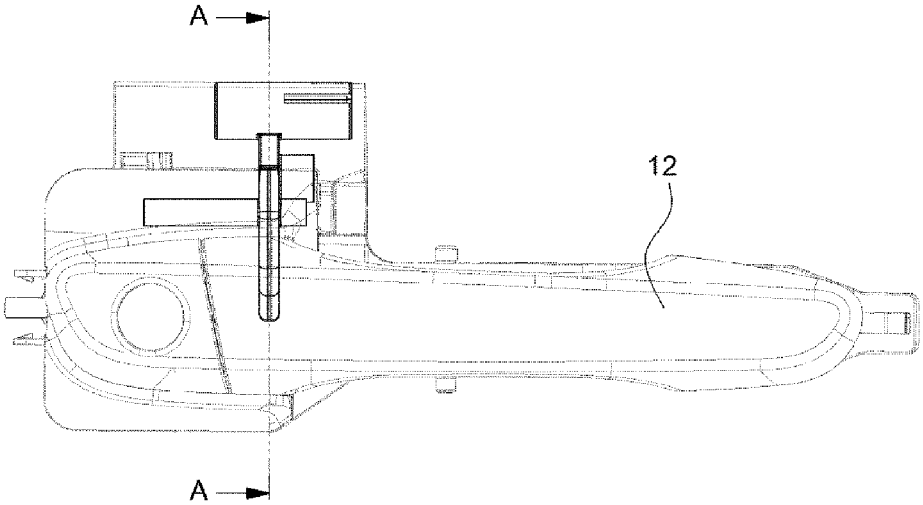
FIG.1B (Related Art)
FIG. 1B represents a rear view of a door assembly of a vehicle in accordance with state of the art.
Figure 2:
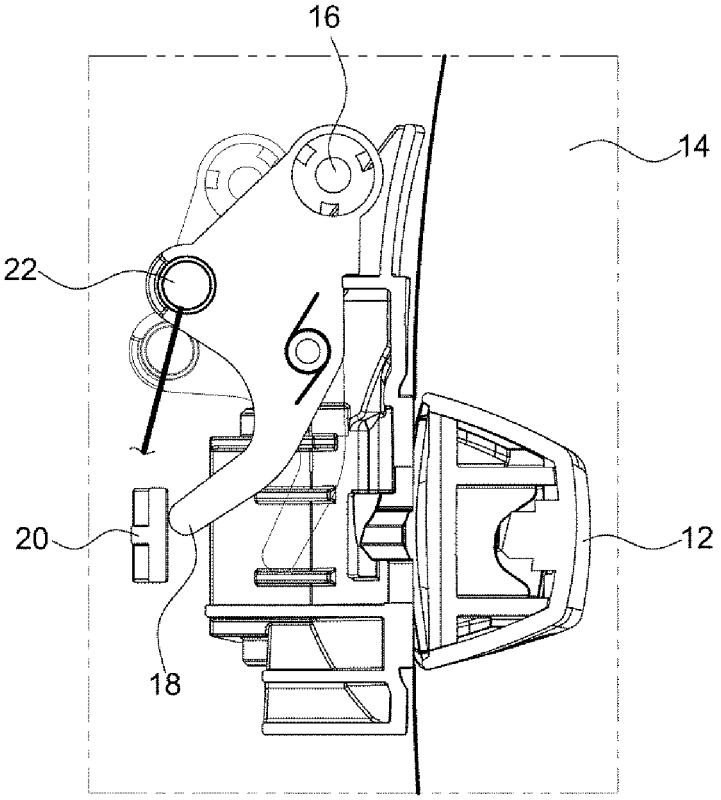
FIG.2 (Related Art)
FIG. 2 represents a sectional view of the door assembly at section A-A of FIG. 1B in accordance with state of the art.
Figure 3A:
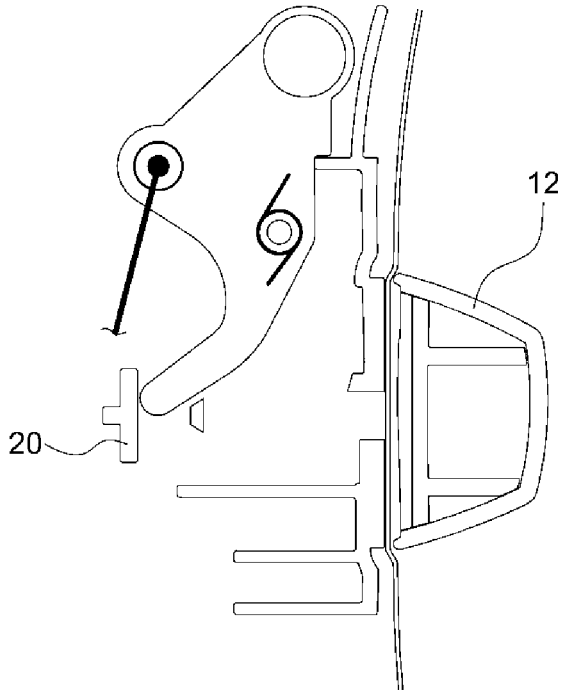
FIG.3A (Related Art)
FIGS. 3A and 3B represent schematic views of a vehicle door assembly at section A-A of FIG. 1B during normal working condition of the vehicle in accordance with state of the art.
Figure 3B:
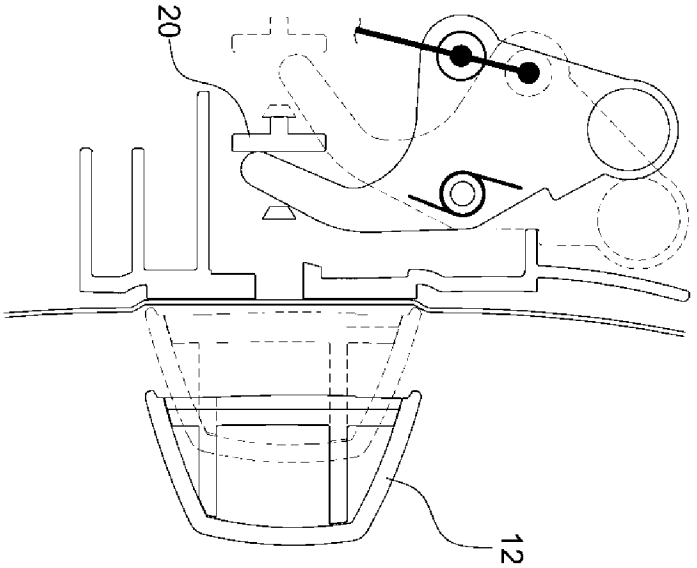
FIG.3B (Related Art)
Figure 4A:
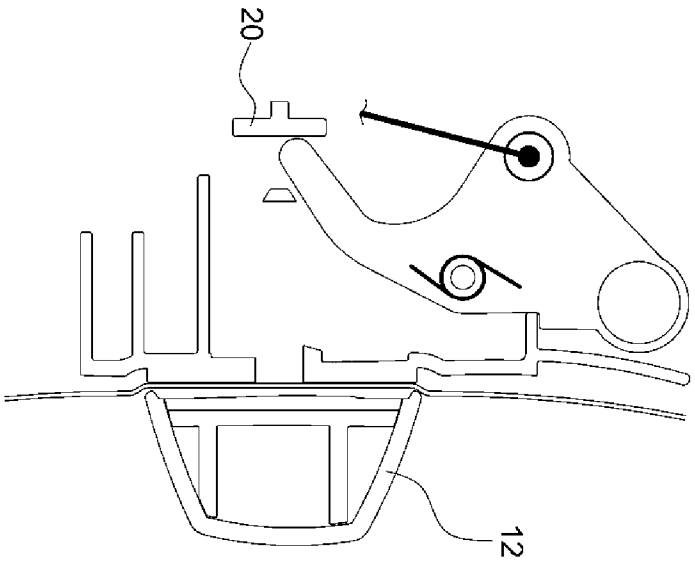
FIG.4A (Related Art)
FIG. 4A and FIG. 4B represent schematic view of a vehicle door assembly at section A-A of FIG. 1B in the event of a side impact in accordance with state of the art.
Figure 4B:
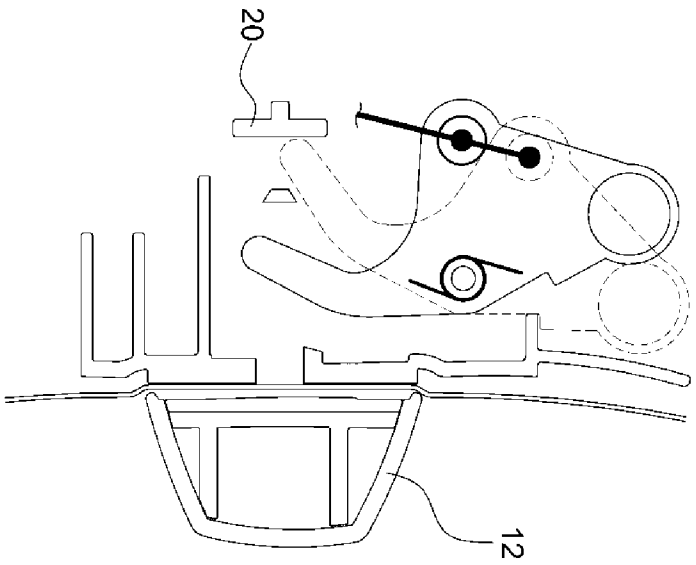
FIG.4B (Related Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 5A:
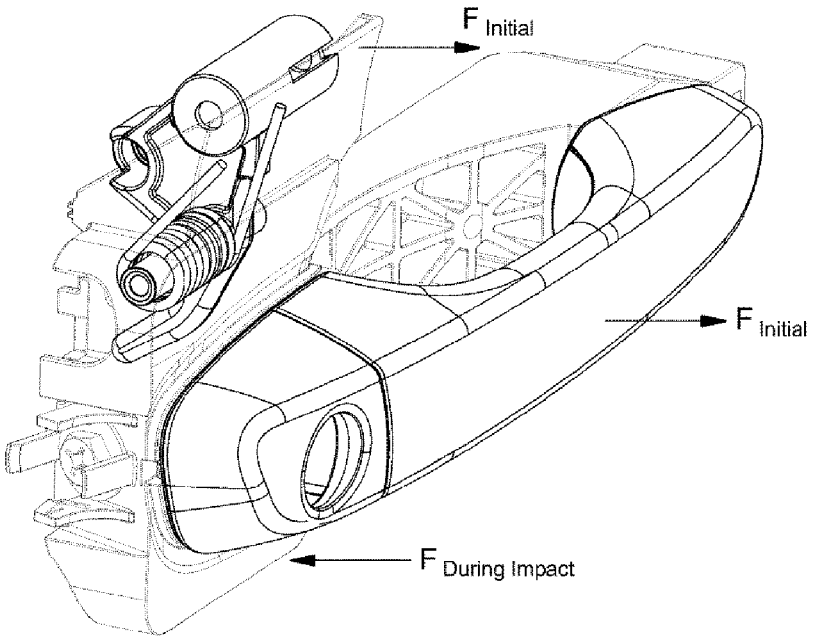
FIG. 5A represent a perspective view of a vehicle door assembly depicting forces acting during side impact in accordance with an exemplary embodiment of the present subject matter.
Figure 5B:
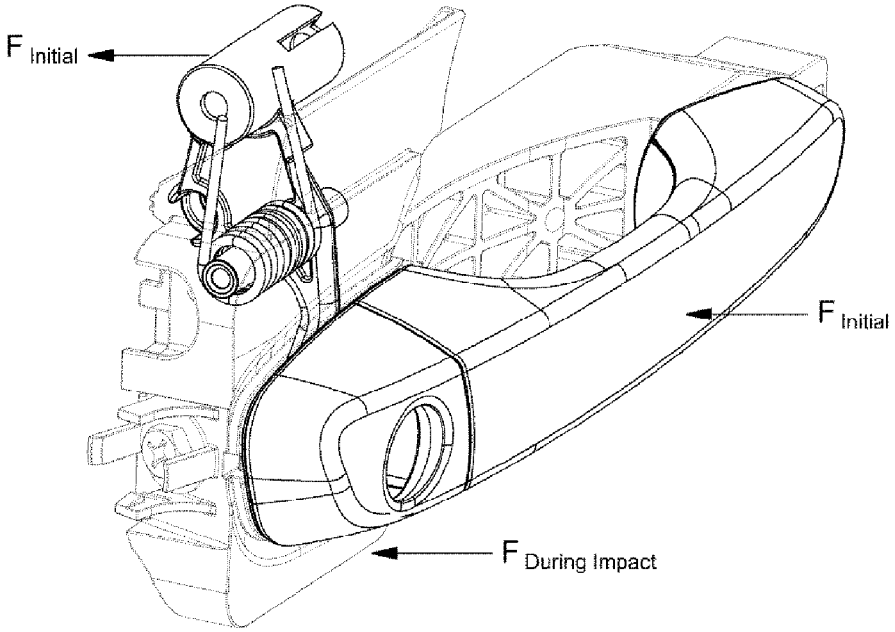
FIG. 5B represents a perspective view of a vehicle door assembly depicting forces acting after the side impact in accordance with an exemplary embodiment of the present subject matter.

Referring FIGS. 5A and 5B, the forces experienced by a vehicle door during side impact are illustrated in accordance to an aspect of the present subject matter. The force that is exerted by the side impact on the vehicle door is referred to as an initial force and is represented by $F_{initial}$. The force opposite in direction and countering the initial force that is exerted by the side impact is referred to as an inertia force and is represented by $F_{inertia}$.

Figure 6A:
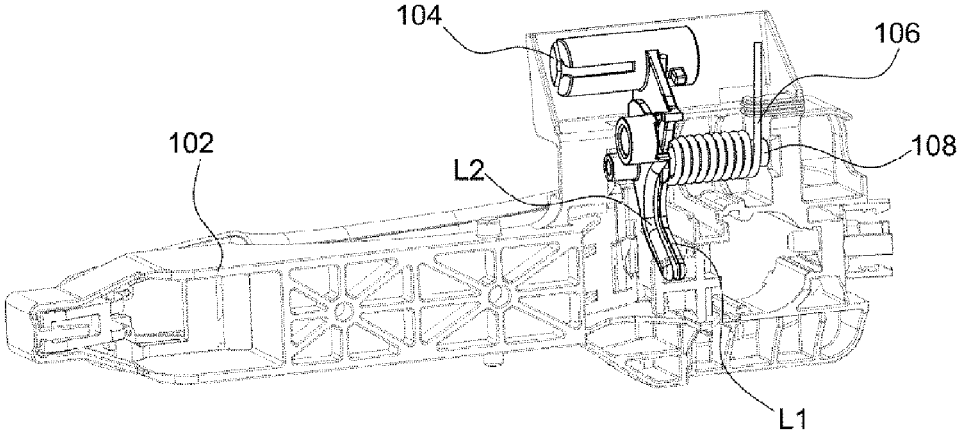
FIG. 6A represents the front view of a door assembly of a vehicle in accordance with an exemplary embodiment of the present subject matter.
Figure 6B:
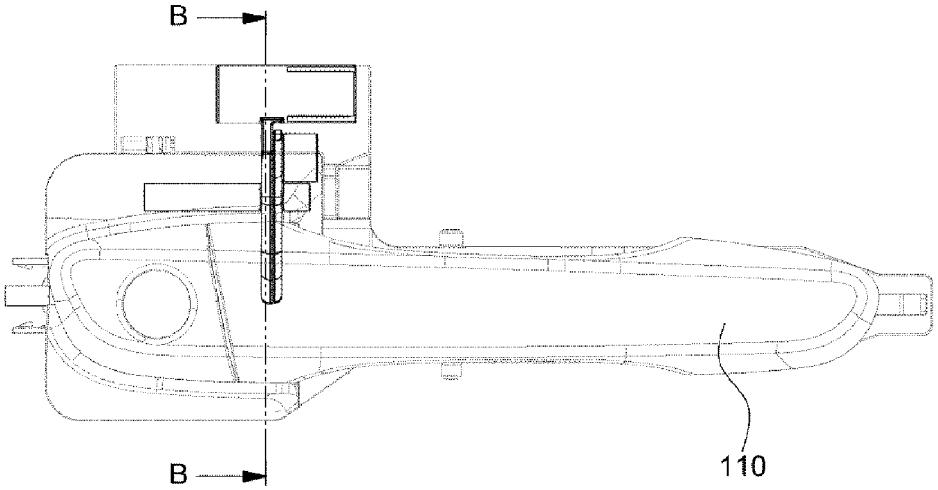
FIG. 6B represents the rear view of a door assembly of a vehicle in accordance with an exemplary embodiment of the present subject matter.

According to an exemplary embodiment of the present subject matter, the mechanism employed in the door assembly of a vehicle to prevent the door from opening in adverse circumstances such as, side impact is illustrated in FIGS. 6A and 6B.

FIG. 6A represents a front view of a vehicle door assembly in accordance with an exemplary embodiment of the present subject matter. The door assembly includes a housing 102. The housing 102 accommodates an actuator assembly that includes a first lever L1 carrying a balance load 104 and a second lever L2 carrying an outside handle rod not shown in FIG. 6A. There is also incorporated a loaded spring 106 that surrounds a pivot shaft 108 attached to the first lever L1 for providing a biasing force on the first lever L1.

FIG. 6B represents a rear view of a vehicle door assembly in accordance with an exemplary embodiment of the present subject matter. As is apparent from FIG. 6B, a grip assembly including a handle grip 110 is located on the outer surface of the housing 102.

Figure 7:
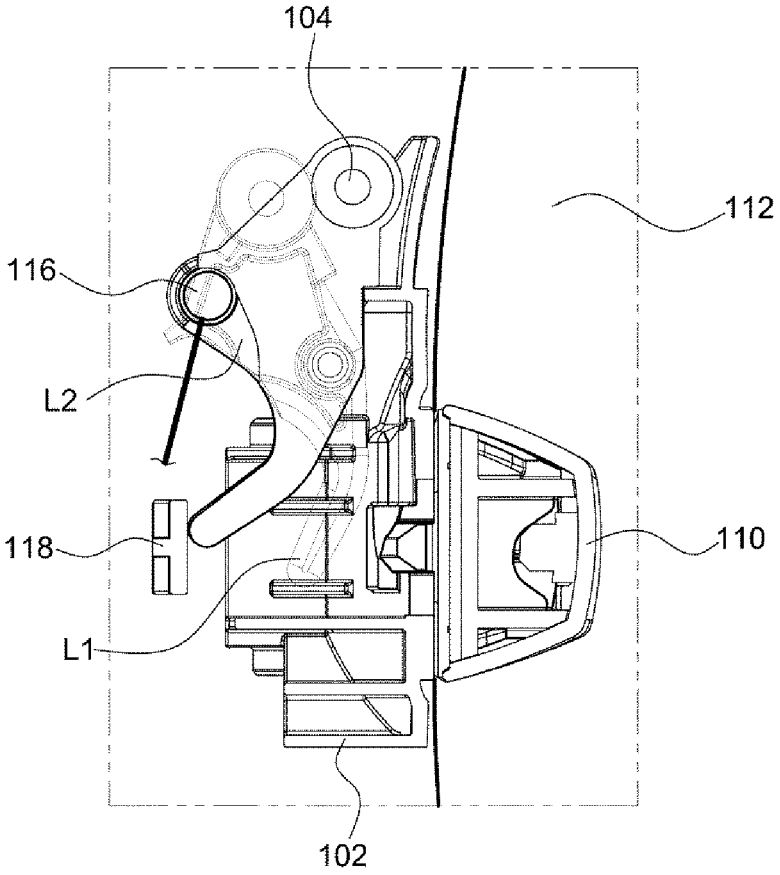
FIG. 7 represents a sectional view of the door assembly at section A-A of FIG. 6B in accordance with an exemplary embodiment of the present subject matter.

According to an exemplary embodiment of the present subject matter, a sectional view of the door assembly at section A-A of FIG. 6B is shown in FIG. 7. As can be seen from FIG. 7, the grip assembly is provided on the outer surface 112 of the door assembly. The housing 102 encompasses an actuator mechanism that includes a set of levers L1, L2. A balance load 104 is provided on a first lever L1 of the set of levers and an outside handle rod 116 is provided on the second lever L2 of the set of levers. The balance load 104 is rotationally coupled to the handle by way of a pivot shaft 108 using a spring arrangement 106. The spring arrangement 106 provides a biasing force to rotate the first lever L1 containing the balance load 104. The outside handle rod 116 connects the outer handle surface to the latch mechanism not shown of the vehicle door. A grip lever 118 is operably connected to the levers L1 and L2 and controls the movement of the handle grip 110.

Figure 8A:
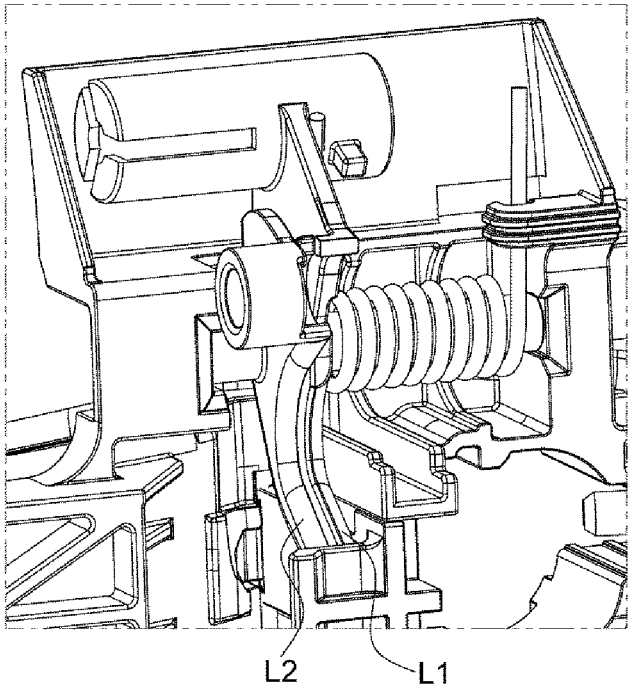
FIG. 8A represent a detailed view of the positioning of levers during side impact in accordance with an exemplary embodiment of the present subject matter.
Figure 8B:
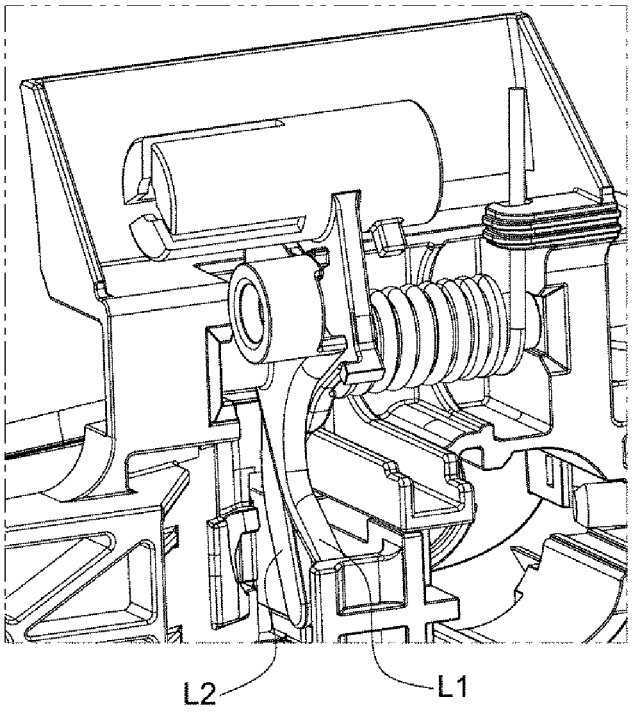
FIG. 8B represent a detailed view of the positioning of levers after side impact in accordance with an exemplary embodiment of the present subject matter.

It is in accordance with an exemplary embodiment of the present subject matter that a detailed view of the positioning of levers L1 and L2 during side impact is shown in FIG. 8A and after the side impact is shown in FIG. 8B. As can be seen from FIGS. 8A and 8B, both the levers L1 and L2 remain in contact with the grip lever 118 during side impact condition. However after the side impact, the first lever L1 pivots away from the grip lever 118 whereas the second lever L2 keeps exerting the holding force on the grip lever 118.

Figure 9A:
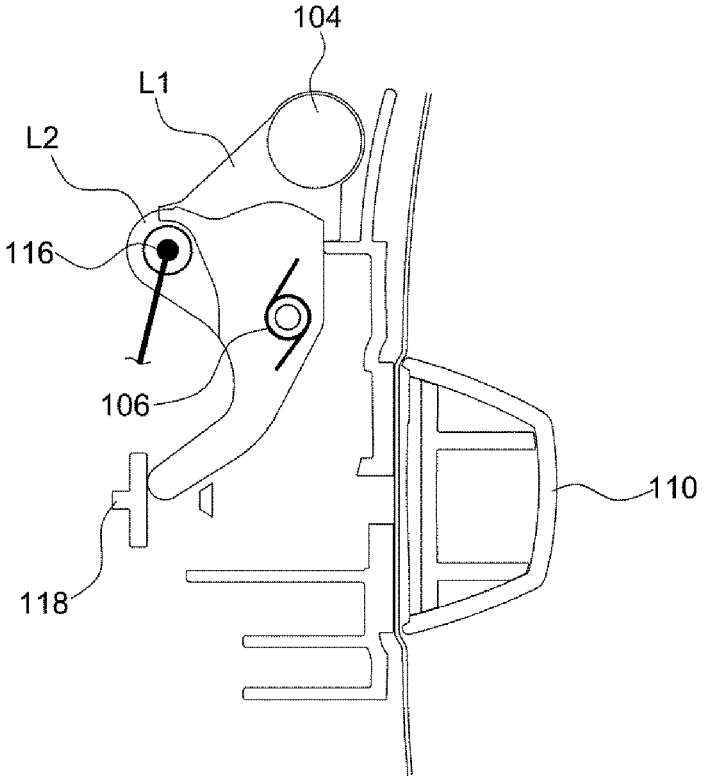
FIG. 9A and FIG. 9B represent schematic views of a vehicle door assembly at section A-A of FIG. 6B during normal working condition in accordance with an exemplary embodiment of the present subject matter.
Figure 9B:
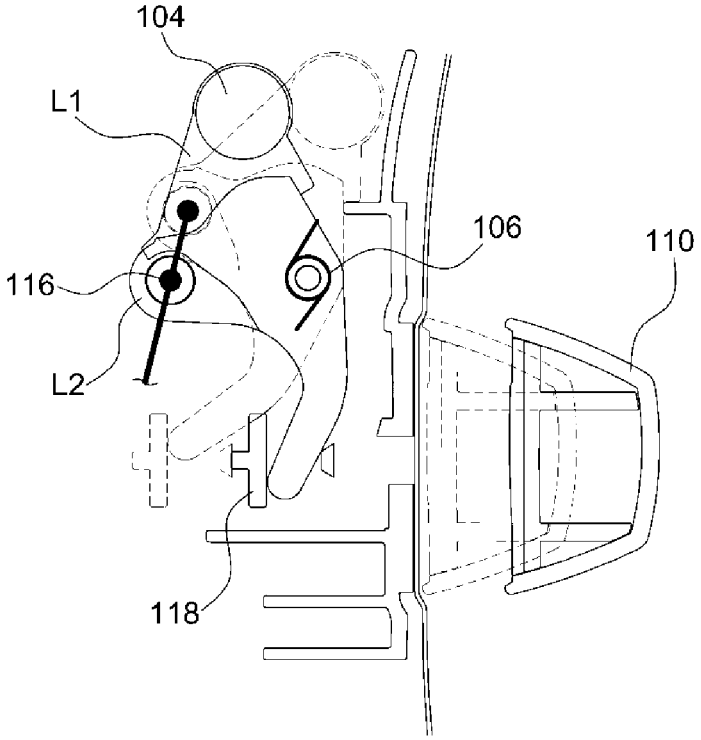

The operation of the actuating mechanism under normal working condition is shown in FIGS. 9A and 9B according to an exemplary embodiment of the present subject matter. The actuator mechanism is operated or is responsive for opening the door of the vehicle by actuating the handle grip 110. The actuator mechanism is accommodated in the housing 102 of the door assembly. The actuator mechanism includes a plurality of levers, wherein the first and second levers L1 and L2 are pivoted to the housing 102 about the pivot shaft 108. As can be seen from FIG. 9A, both the first and second levers L1 and L2 are in contact at their bottom end with the grip lever 118, thereby exerting a holding force on the grip lever 118. Upon actuating the handle grip 110, the first lever L1 carrying the balance load 104 and second lever L2 carrying the outside handle rod 116 are set to rotate about the pivot shaft 108. Simultaneously, the release of the outside handle rod 116 which is connected to the latch mechanism not shown unlatches the lock and opens the door of the vehicle.

Figure 10A:
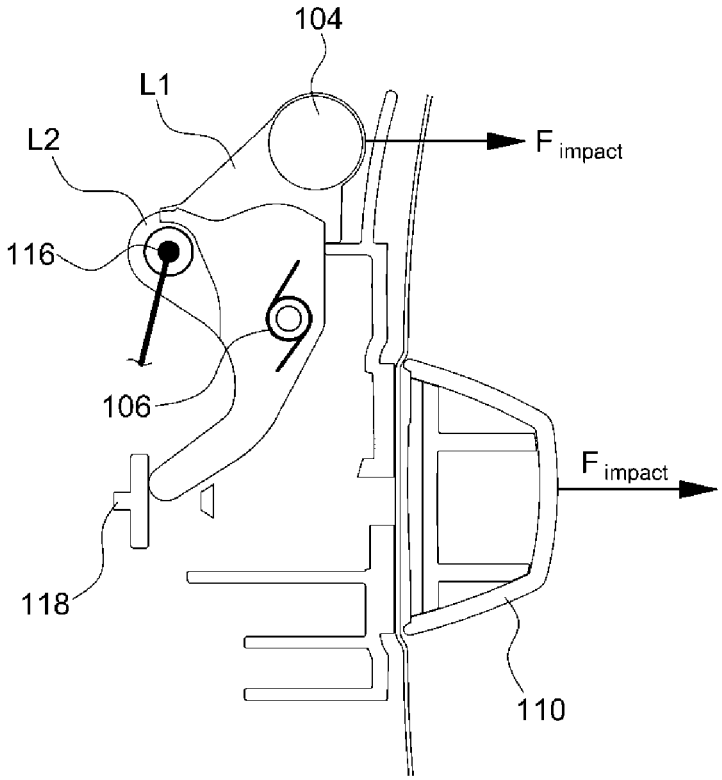
FIG. 10A and FIG. 10B represent schematic views of a vehicle door assembly at section A-A of FIG. 6B in the event of a side impact in accordance with an exemplary embodiment of the present subject matter.
Figure 10B:
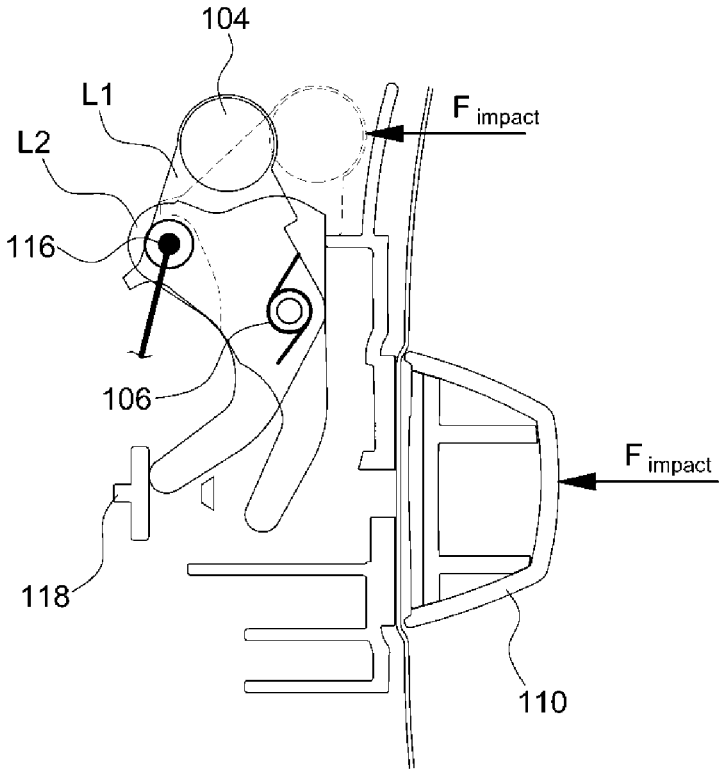

According to an exemplary embodiment of the present subject matter, the actuating mechanism operating the vehicle door assembly on event of experiencing a side impact is shown in FIGS. 10A and 10B. The side impact exerts the impact force or the initial force $F_{initial}$ on the vehicle door assembly. On experiencing the impact force $F_{initial}$ during the side impact, the grip lever 118 is in contact with the levers L1 and L2 which exert a holding force on the grip lever 118. After experiencing the impact force, the inertia force $F_{inertia}$ rotates the balance load 104 carried by the lever L1. However, the lever L2 carrying outside handle rod 116 remains affixed and does not release outside handle rod 116 from its set position. As a result, the latching mechanism not shown connected by the rod 116 remains at its latching position and hence, the vehicle door remains closed or locked.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door handle assembly configured for installation in a motor vehicle door, the door handle assembly comprising:

a housing accommodating an actuator mechanism; and a grip assembly activating the actuator mechanism;

wherein the actuator mechanism includes:

a plurality of levers juxtaposed to each other and pivotably positioned in the housing by a pivot, each lever being separately pivotable on the pivot, wherein the plurality of levers includes a first lever and a second lever, wherein each of the first lever and the second lever is positioned to be in direct contact with a grip lever during a normal working condition and during a side impact condition of a vehicle, thereby exerting a holding force on the grip lever, and wherein after experiencing the side impact condition, the first lever is configured to rotate about the pivot and to be released from the direct contact of the grip lever with the first lever, and the second lever continues engaged to the grip lever and exerting the holding force on the grip lever.

2. The door handle assembly as claimed in claim 1, wherein the grip assembly is attached to an outer surface of the housing.

3. The door handle assembly as claimed in claim 1, wherein the first lever is spring loaded.

4. The door handle assembly as claimed in claim 1, wherein the first lever and the second lever are pivoted within the housing by a pivot shaft.

5. The door handle assembly as claimed in claim 1, wherein the first lever is configured to carry a balance load and the second lever is configured to carry an outside handle rod.

6. The door handle assembly as claimed in claim 1, wherein the first lever and the second lever are in contact with a grip lever at a bottom end thereof.

7. A door handle assembly configured for installation in a motor vehicle door, the door handle assembly comprising:

a housing accommodating an actuator mechanism; and a grip assembly activating the actuator mechanism;

wherein the actuator mechanism includes:

a first lever and a second lever which are juxtaposed to each other and pivotably positioned in the housing on a pivot, each lever being separately pivotable on the pivot;

wherein each of the first lever and the second lever is positioned to be in direct contact with a grip lever at bottom ends thereof during a normal working condition and during a side impact condition of a vehicle, thereby exerting a holding force on the grip lever, and wherein after experiencing the side impact, the first lever is configured to rotate about the pivot and to be released from the direct contact of the grip lever with the first lever such that the bottom end of the first lever moves away from the grip lever whereas the bottom end of the second lever continues to be in contact with the grip lever thereby exerting the holding force on the grip lever, and wherein the first lever is configured to carry a balance load at an upper portion thereof, and the second lever is configured to carry an outside handle rod at an upper portion thereof.

* * * * *